US008793915B2

(12) United States Patent
Morando

(10) Patent No.: US 8,793,915 B2
(45) Date of Patent: Aug. 5, 2014

(54) FIREARM DISASSEMBLY TONGS

(76) Inventor: Gregory Morando, Huntsville, AL (US)

( * ) Notice: Subject to any disclaimer, the term of this patent is extended or adjusted under 35 U.S.C. 154(b) by 155 days.

(21) Appl. No.: 13/252,474

(22) Filed: Oct. 4, 2011

(65) Prior Publication Data

US 2013/0081318 A1 Apr. 4, 2013

(51) Int. Cl.
*F41A 17/00* (2006.01)
*F41A 35/00* (2006.01)

(52) U.S. Cl.
CPC ..... *F41A 35/00* (2013.01)
USPC ..... 42/70.11

(58) Field of Classification Search
USPC ..... 42/70.11, 108, 70.06, 70.07, 90; 89/1.4, 89/1.42; 24/531, 532, 545, 546, 556, 455; D8/313, 325, 328, 72; D19/65
See application file for complete search history.

(56) References Cited

U.S. PATENT DOCUMENTS

| | | | | | |
|---|---|---|---|---|---|
| 1,470,280 | A * | 10/1923 | McCulloch | 24/540 |
| 3,349,771 | A * | 10/1967 | Baer | 606/157 |
| D229,392 | S * | 11/1973 | Faust | D8/394 |
| D284,920 | S * | 8/1986 | Van Horn | D6/491 |
| 5,657,518 | A * | 8/1997 | Hunt | 24/543 |
| 6,389,726 | B1 * | 5/2002 | Bentley | 42/70.07 |
| 6,494,517 | B1 * | 12/2002 | Durant | 294/99.2 |
| 6,920,713 | B1 * | 7/2005 | Love | 42/94 |
| D522,834 | S * | 6/2006 | Lalancette et al. | D8/72 |
| 7,234,745 | B1 * | 6/2007 | Tsai | 294/99.2 |
| D590,443 | S * | 4/2009 | Goldman et al. | D19/65 |
| 2002/0124361 | A1 * | 9/2002 | Tamura | 24/546 |
| 2003/0230906 | A1 * | 12/2003 | Bennett et al. | 294/99.2 |
| 2005/0001439 | A1 * | 1/2005 | Lukaszynski et al. | 294/99.2 |
| 2006/0091684 | A1 * | 5/2006 | Frauscher | 294/99.2 |
| 2009/0173035 | A1 * | 7/2009 | Collins | 52/702 |
| 2009/0293242 | A1 * | 12/2009 | Bithell et al. | 24/458 |
| 2010/0280544 | A1 * | 11/2010 | Banks | 606/210 |
| 2012/0192474 | A1 * | 8/2012 | Pratt | 42/70.11 |

* cited by examiner

*Primary Examiner* — Samir Abdosh
*Assistant Examiner* — John D Cooper
(74) *Attorney, Agent, or Firm* — Bennet K. Langlotz; Langlotz Patent & Trademark Works, Inc.

(57) ABSTRACT

Firearm disassembly tongs having a generally U-shaped body having two arms joined at one end by a bottom portion, the arms having a free end portion having a flat interior surface portion with a slot therein. Each of the arms may have a textured exterior surface portion. Each of the arms may have a concave interior surface portion below the flat interior surface portion. Each of the concave interior surface portions may define a stop surface that limits upward motion of the tongs when the stop surfaces are engaged with a firearm. The stop surfaces may locate the slots in each flat interior surface portion to receive a slide lock of a firearm when the stop surfaces are engaged with the firearm. The stop surfaces may be curved radiused shapes that engage a radiused underside portion of a firearm frame above a trigger area defined by a trigger guard.

39 Claims, 7 Drawing Sheets

FIREARM DISASSEMBLY TONGS

FIELD OF THE INVENTION

The present invention relates to firearms, and more particularly to tongs that engage the slide lock of a semi-automatic pistol to enable disassembly of the pistol.

BACKGROUND OF THE INVENTION

Many semi-automatic pistols, including every model manufactured by GLOCK® Gesellschaft mbH, the Taurus® 24/7 G2 models of semi-automatic pistols, and the Smith & Wesson® SD9™ models of semi-automatic pistols, have slides that must be removed from their frames so the firearm can be disassembled for cleaning and lubrication. These pistols have a slide lock that must be bilaterally disengaged before the slide can be removed from the frame.

In the case of a pistol 100 manufactured by GLOCK® Gesellschaft mbH, an example of which is shown in FIG. 1, removal of the slide 106 from the frame 108 is accomplished as follows:

First, with the striker down or in the fired position, the user grasps the pistol in one hand with the rear 104 of the pistol resting in the web of the hand and with the fingers resting over the slide so the thumb rests on the rear of the frame.

Second, the user draws back the slide about 3 mm with the fingers of the hand grasping the pistol.

Third, the user pulls down on the slide lock 116 in the slots 120 located on either side of the frame with the free hand to release tension on the slide. Indentations 114 immediately surrounding the slots 120 receive the user's finger pads.

Fourth, the user pushes the slide towards the front 102 of the pistol to separate the slide from the frame. This enables the recoil spring (not shown) and the barrel 110 to be removed from the slide.

Although the slide lock has a plurality of teeth 118 and protrudes outwards from the slot in the frame, the slide lock can still be difficult to grasp and operate with the thumb and forefinger of the user's free hand while keeping the slide drawn back with the hand grasping the pistol.

Therefore, there is a need for firearm disassembly tongs that readily engage the slide lock of a pistol to provide increased mechanical advantage to enable easy removal of the slide of a pistol from the frame of a pistol.

SUMMARY OF THE INVENTION

The present invention provides improved firearm disassembly tongs, and overcomes the above-mentioned disadvantages and drawbacks of the prior art. As such, the general purpose of the present invention, which will be described subsequently in greater detail, is to provide improved firearm disassembly tongs that have all the advantages of the prior art mentioned above.

To attain this, the preferred embodiment of the present invention essentially comprises a generally U-shaped body having two arms joined at one end by a bottom portion, the arms having a free end portion having an interior surface portion with a slot therein. Each of the arms may have a textured exterior surface portion. Each of the arms may have a concave interior surface portion below the flat interior surface portion. Each of the concave interior surface portions may define a stop surface that limits upward motion of the tongs when the stop surfaces are engaged with a firearm. The stop surfaces may locate the slot in each flat interior surface portion to receive a slide lock of a firearm when the stop surfaces are engaged with the firearm. The stop surfaces may be angled shapes that engage a radiused underside portion of a firearm frame above a trigger area defined by a trigger guard. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
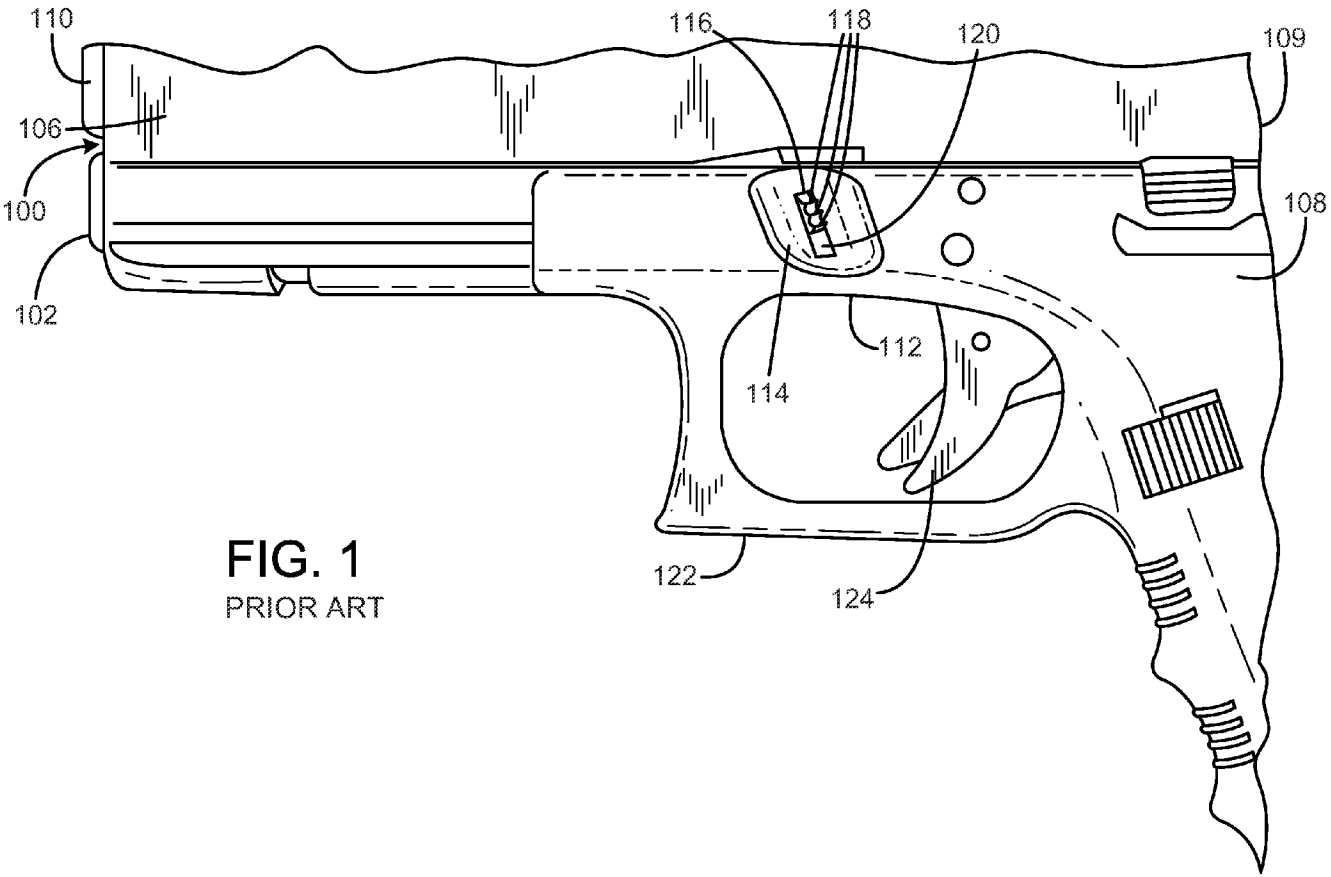
FIG. 1 PRIOR ART
FIG. 1 is a side fragmentary view of a prior art firearm manufactured by GLOCK® Gesellschaft mbH with the slide lock in its locked position.
Figure 2:
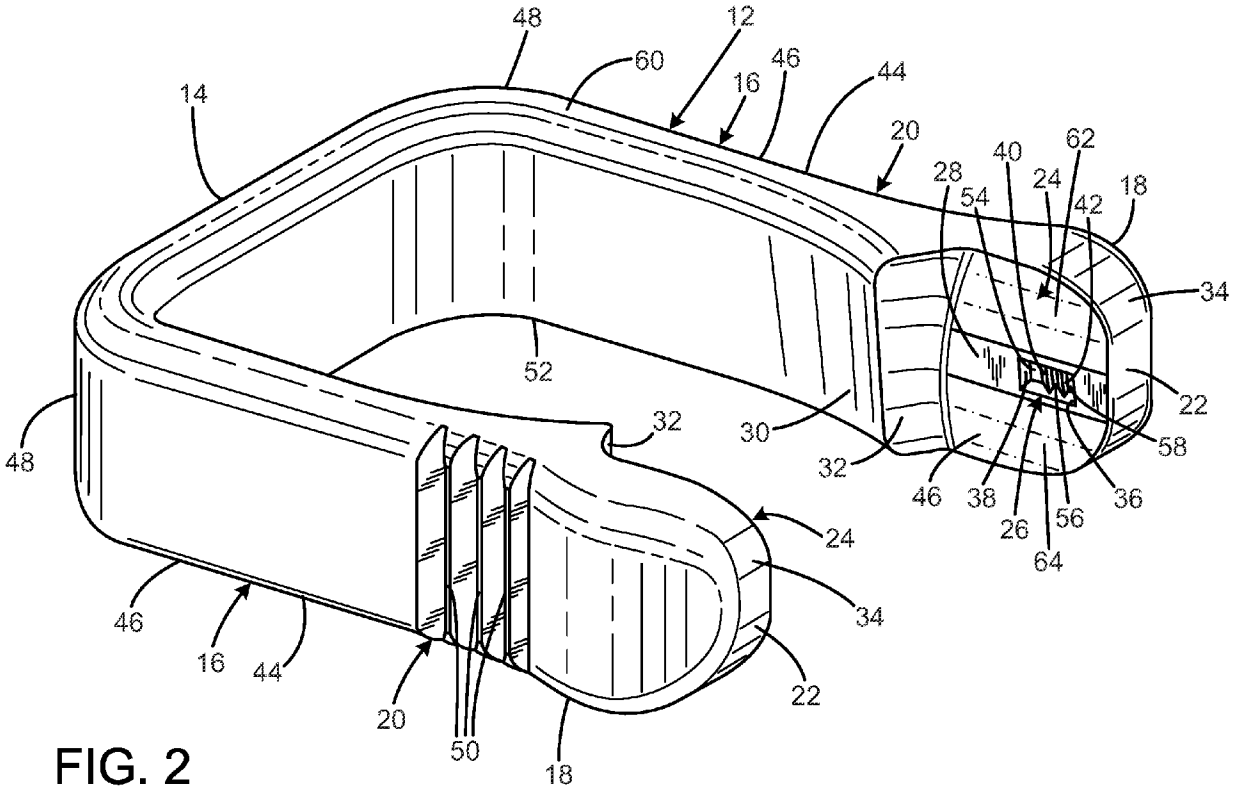
FIG. 2 is a top perspective view of a firearm disassembly tongs constructed in accordance with the principles of the present invention.
Figure 4:
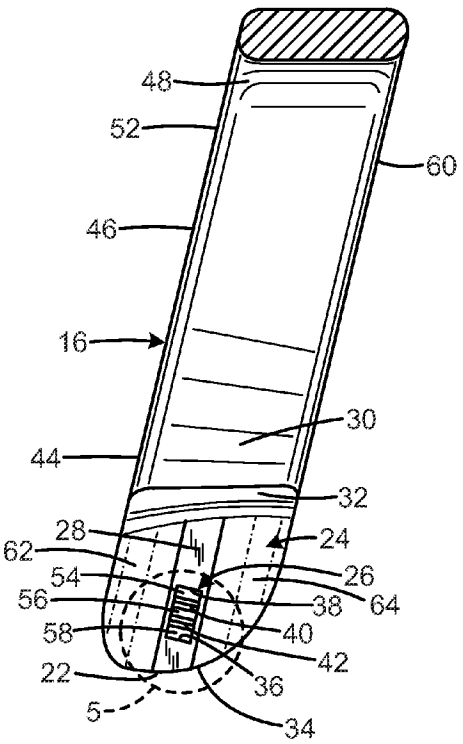
FIG. 4 is an interior fragmentary view taken along the line 4-4 of FIG. 2.
Figure 3:
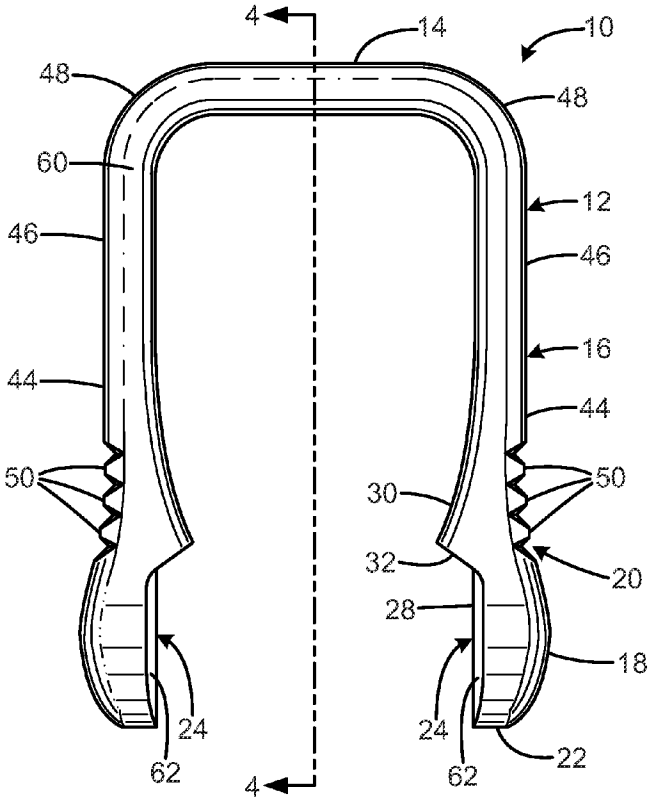
FIG. 3 is a top view of the tongs of FIG. 2.
Figure 5:
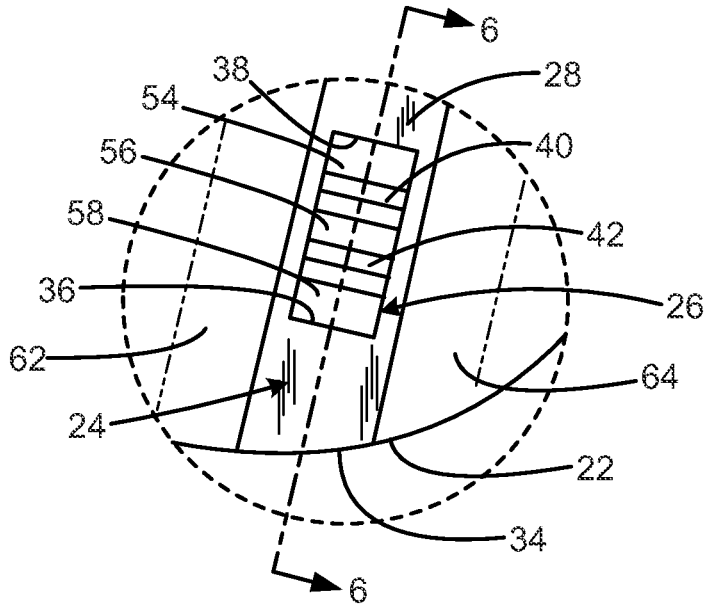
FIG. 5 is a close-up view of the area encircled by the line 6 of FIG. 4.
Figure 6:
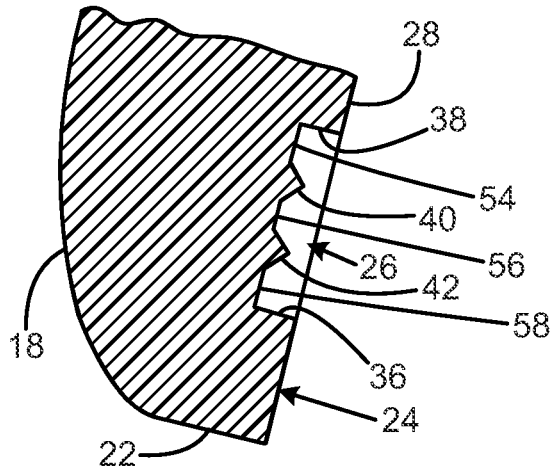
FIG. 6 is a sectional view taken along line 6-6 of FIG. 5.

A preferred embodiment of the firearm disassembly tongs of the present invention is shown and generally designated by the reference numeral 10.

FIGS. 2-5 illustrate the improved firearm disassembly tongs of the present invention. More particularly, the tongs 10 have a generally U-shaped body 12 with two arms 16 that are joined at one end by a base 14. Each arm has a curved portion 48, which is connected to the base, a lower arm portion 46, and an upper arm portion 44. The opposing free ends of the arms each form a tip 22.

Each of the arms has an exterior surface 18 and an interior surface 24. The exterior surface of each tip defines a convex cylindrical surface 34 that acts as a sloped cam surface. The exterior surface of each arm has a rough texture 20 preferably created by three teeth 50. However, the rough texture may be created by more or fewer teeth than three. In addition, other exterior surfaces of the tongs 10 may have a rough texture.

Each interior surface has a flat portion 28 with a recess or slot 26 that runs parallel to the arm. Each of the flat portions 28 has cylindrically convex surfaces 62 and 64 on either side. The uppermost portion of each slot defines a downward facing ledge 36, and the bottommost portion of each slot defines an upward facing ledge 38. Each slot has two teeth 40 and 42 located between the ledges. The spaces between the teeth and the ledges define three compartments 54, 56, and 58. The compartments are sized and shaped to closely receive the teeth 118 on the slide lock 116 of the pistol 100.

Each arm 16 has a ledge 32 located immediately below the flat interior surface 28. The ledges are an angled shape that extends inwards, decreasing the distance between the two arms.

The underside of each of the ledges 32 forms a curved surface 30 that is part of the upper arm 44. The upper and lower arm portions below the curved surfaces, as well as the base of the body, have a rounded, flattened cylindrical shape. The tongs are made from a moderately flexible material to permit the arms to bend repeatedly inwards and outwards up to about ½ inch (about 25-30°) with respect to the base without fracturing. In the current embodiment, the tongs are made from nylon with up to a 15% by weight glass filler to provide stiffness and durability.

Figure 7:
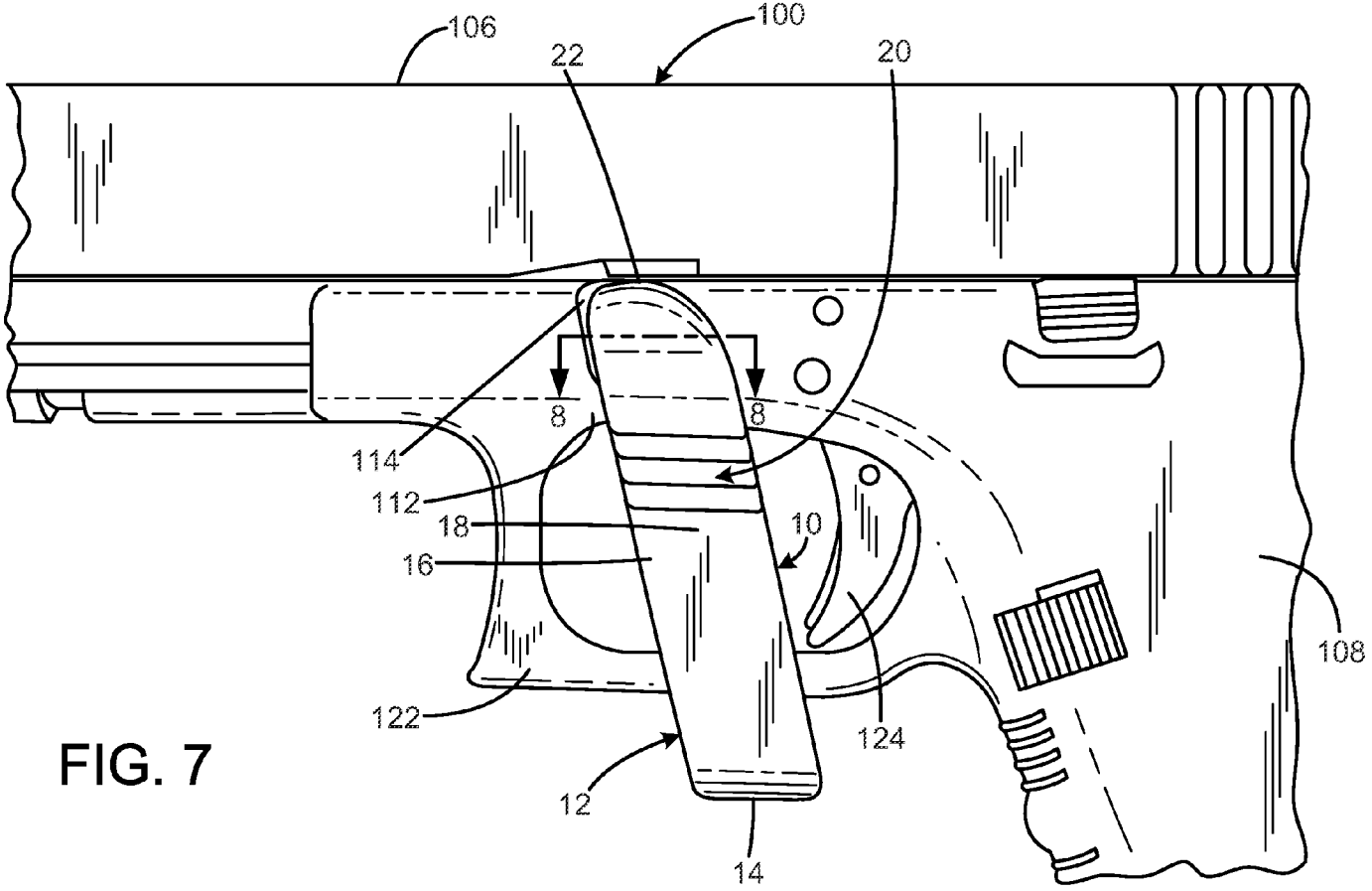
FIG. 7 is a side view of the tongs of FIG. 2 engaged with the slide lock of the pistol of FIG. 1 with the slide lock in the locked position.
Figure 8:
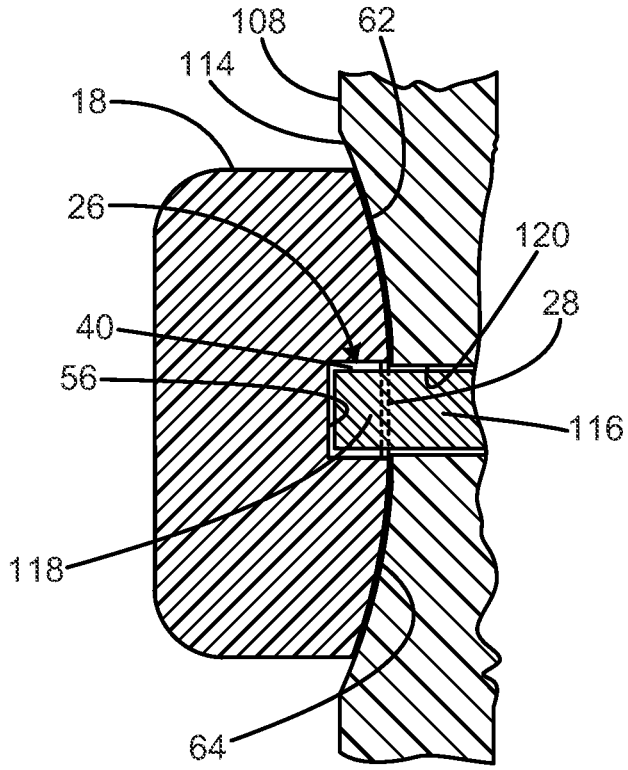
FIG. 8 is a cross-section view from above of FIG. 7 showing the tongs of FIG. 2 engaged with the slide lock of the pistol of FIG. 1 with the slide lock in the locked position.
Figure 9:
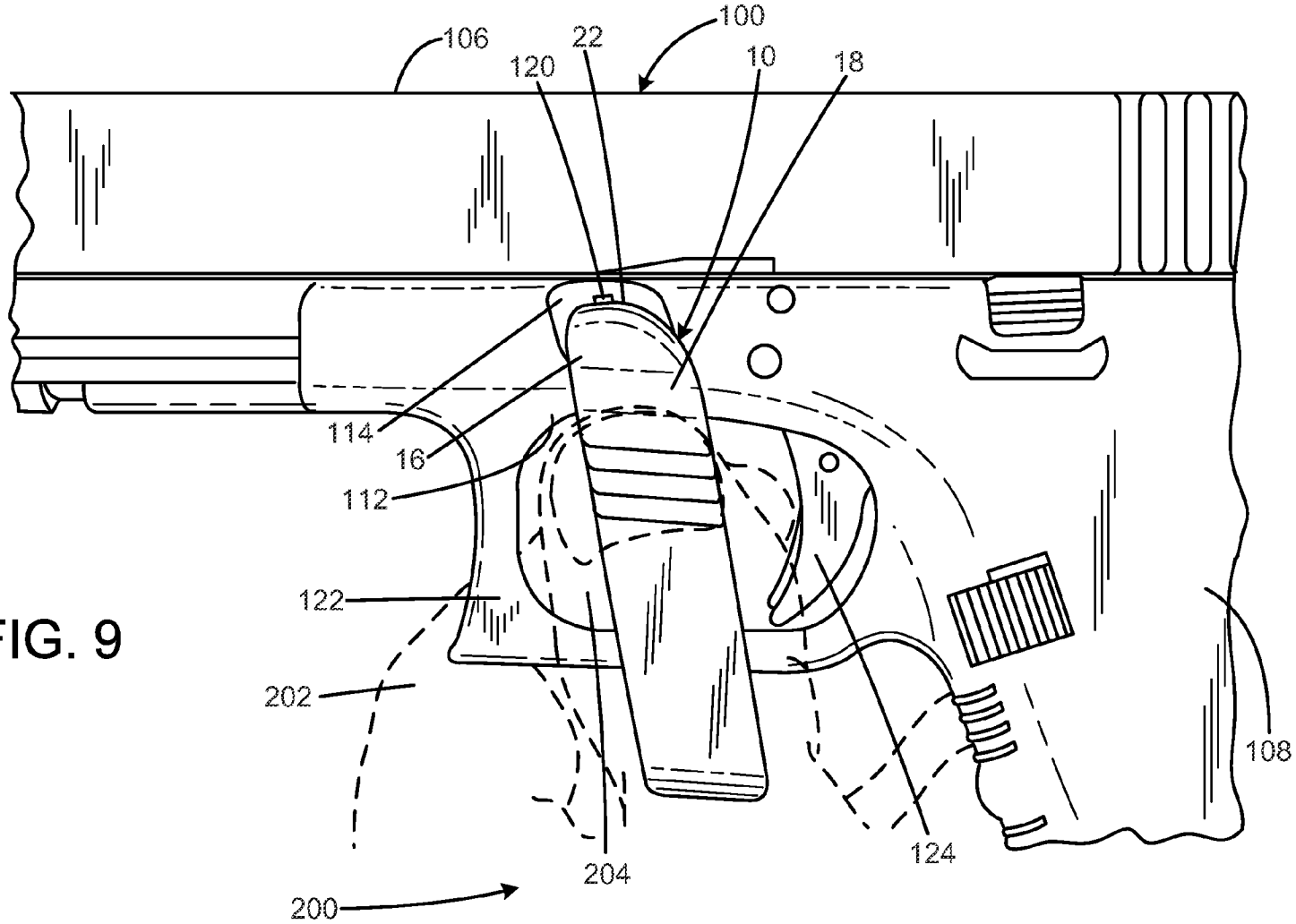
FIG. 9 is a side view of the tongs of FIG. 2 engaged with the slide lock of the pistol of FIG. 1 with the slide lock in the released position.

FIG. 7-9 show how the firearm disassembly tongs 10 of the current invention operate with a pistol 100 to enable removal of the slide 106 from the frame 108. More particularly, in FIGS. 7 and 8, the tips 22 of the tongs have been slid upwards over the trigger guard 122 and frame until the ledges 32 rest against the radiused underside 112 of the frame in the trigger area defined by the trigger guard in front of the trigger 124. The arms 16 are preferably attached to the base 14 of the tongs at a rearward angle of about 13° to position the slots 26 at an appropriate angle to engage the entire slide lock 116. However, the arms can be attached at any angle to the base ranging from 0° (vertical) to about 15°. The cylindrically convex surfaces 62 and 64 are sized to mimic finger pads and therefore closely fit the indentations 114 surrounding the slots 120 in the pistol frame 108. The ledges and concave surfaces 30 are shaped and curved with a radius of 1.95 to conform closely to the frame and provide stop surfaces that limit upward movement of the arms. Furthermore, because of precise spacing between the stop surfaces and the slots 26, the stop surfaces also locate the slots 26 with respect to the slide lock when the ledges contact the underside of the frame. The sloped cam surfaces 34 on the tips prevent the uppermost portion of the tips from catching on the slide lock as the tongs are pushed upwards. The arms are sufficiently long that the bottom 14 of the body 12 clears the trigger guard 122.

In this position, the flat surfaces 28 of the tips are angled inwards to fit into the indentations 114 on either side of the frame. The slots 26 are correspondingly positioned at an angle to receive the slide lock 116. Specifically, the downward facing ledges 36 and compartments 54, 56, and 58 in each slot closely receive the three teeth 118 on each slide lock. The teeth 50 are similarly angled so the teeth 50 are horizontal when the tongs are engaged with the slide lock.

Subsequently, as is shown in FIG. 8, the user's hand 200 grasps the exterior 18 of the tongs 10 below the ledges 32 between the thumb 204 and forefinger 202 and pinches the arms 16 together. The user then pulls the tongs downwards, which pulls the slide lock 116 down in the slots 120 via downward force exerted by the downward facing ledge 36 and teeth 40 and 42 on all three teeth 118 on each slide lock, and then releases the slide 106 from the frame 108. The texture 20 on the exterior of the arms provides a firm grip during the downwards movement of the tongs.

The firearm disassembly tongs 10 of the current invention have the following characteristics to enable their usage with every pistol model manufactured by GLOCK Gesellschaft mbH. The widest portion of the tongs is 1.52 inches. The longest portion of the tongs is at least 2.00 inches so the base does not contact the trigger guard, with a preferred length of 2.13 inches. The distance from the exterior surface of the base 14 to each of the ledges 32 is 1.54 inches. This enables the tongs to clear the trigger guard 122, which extends about 1.125 inches below the front of the underside of the frame where the ledges rest and about 1.094 inches below the rear of the underside 112 of the frame 108 where the ledges rest. The bottom of the frame is not square, but slopes upwards towards the muzzle of the barrel 110. The base has a thickness of 0.17 inches. Each arm meets the bottom in a curved portion 48 with an exterior radius of 0.35. Each arm has a thickness of 0.53 inches. The top surface 60 and bottom surface 52 of each arm have a curved radius of 0.06. The distance between the ledges is 0.78 inches, and the ledges are angled at 54° from vertical. The curved surfaces 30 below the ledges have a radius of 1.58. This enables the tongs to closely fit the radiused underside of the frame, which is about 1 inch wide where the ledges rest.

The distance between the ledges 32 and the two teeth 40 and 42 in each arm is 0.44 inches and 0.50 inches. The distance between the ledges 32 and the upward facing ledge 38 is 0.38 inches. The distance between the uppermost portion of the tip 22 and the downward facing ledge 36 is 0.13 inches. These distances correspond to the spacing between the teeth 118 on the slide lock 116 and the underside of the frame when the slide lock is locked (the vertical distance from the bottommost tooth to the bottom of the frame is 0.3125 inches). The distance between the highest portion of the slide lock and the underside of the frame is about 0.469 inches. The distance from the bottommost ledge 36 to the bottommost tooth 40 is 0.06 inches, the distance between the teeth 40 and 42 is 0.06 inches, and the distance between the uppermost tooth 42 and the uppermost ledge 38 is 0.05 inches. The slots 26 have an overall depth of 0.04 inches, and the teeth 40 and 42 are 0.02 inches tall. The teeth form 90° angles. These characteristics enable the resulting compartments 54, 56, and 58 in each slot to closely correspond to the dimensions of the teeth 118. Each flat interior surface 28 is 0.49 inches long. The distance between the flat interior surfaces of the tips is 1.03 inches. This enables the tongs to closely fit the slides 106 of all Glock® pistol models presently in existence, which have slide widths of 1.13 inches, 1.18 inches, or 1.27 inches. The sloped cam surfaces 34 on each tip have a radius of 0.35.

While a current embodiment of the firearm disassembly tongs has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitably flexible and durable material could be used in addition to the nylon or nylon with glass filler material described. In addition, minor modifications to the dimensions of the firearm disassembly tongs can be made to enable them to fit the slide locks and frames of Taurus® 24/7 G2 models of semi-automatic pistols, Smith & Wesson® SD9™ models of semi-automatic pistols, and other semi-automatic pistols instead of the pistols manufactured by GLOCK® Gesellschaft mbH that are described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. Tongs for a firearm comprising:

a generally U-shaped body having two elongated arms joined at one end by a bottom portion;

the arms each having a free end portion;

each free end portion having an interior surface portion;

each interior surface portion defining a recess;

each recess having a back wall with recess contours that engage features on a slide removal element of a firearm;

each recess defining a ledge facing toward the bottom portion;

the ledge having an edge substantially flush with the interior surface portion;

each of the arms having a concave interior surface portion below the interior surface portion that defines the recess; and wherein the concave interior surface portions extend inwards, decreasing the distance between the two arms.

2. The tongs of claim 1, wherein each of the arms has a textured exterior surface portion.

3. The tongs of claim 1, wherein each of the concave interior surface portions defines a stop surface that limits upward motion of the tongs when the stop surfaces are engaged with a firearm.

4. The tongs of claim 3, wherein the stop surfaces locate the recess in each interior surface portion to receive a slide lock of a firearm when the stop surfaces are engaged with the firearm.

5. The tongs of claim 3, wherein the stop surfaces are angled shapes that engage a radiused underside portion of a firearm frame above a trigger area defined by a trigger guard.

6. The tongs of claim 3, wherein the arms have a length sufficient such that the bottom portion does not contact a trigger guard when the stop surfaces are engaged with a firearm.

7. The tongs of claim 3, wherein each recess is located 0.38 inches above the stop surface.

8. The tongs of claim 3, wherein the distance between the stop surfaces is 0.78 inches.

9. The tongs of claim 3, wherein the distance between the bottom portion and the stop surfaces is 1.54 inches.

10. The tongs of claim 1, wherein the interior surface portions that define the recesses are flat.

11. The tongs of claim 1, wherein the bottom portion has a rounded, flattened cylindrical shape in cross-section.

12. The tongs of claim 1, wherein a portion of the arms between the bottom portion and the concave interior surface portions has a rounded, flattened cylindrical shape in cross-section.

13. The tongs of claim 1, wherein the recess contours are two teeth that define three compartments transverse to the arm.

14. The tongs of claim 13, wherein each of the concave interior surface portions defines a stop surface that limits upward motion of the tongs when the stop surfaces are engaged with a firearm.

15. The tongs of claim 14, wherein the two teeth are located 0.44 inches and 0.50 inches, respectively, above the stop surfaces.

16. The tongs of claim 1, wherein each recess is parallel to the arm.

17. The tongs of claim 1, wherein the arms extend upwards from the bottom portion at an angle of at least 0° from vertical and less than or equal to 15° from vertical.

18. The tool of claim 1 wherein the slide removal element of the firearm is a slide lock.

19. The tool of claim 1 wherein the features on the slide removal element engaged by the contours are three teeth.

20. The tool of claim 1 wherein the arms are made of a material that is softer than steel.

21. A tool for disassembling a pistol having a removable slide releasable by a slide lock element protruding from a recessed frame portion having a selected frame contour, the tool comprising:

a U-shaped body having elongated parallel arms extending from a base;

the arms being spaced apart to receive the recessed frame portion;

the arms having free ends with opposed inner surface portions having a contour closely conforming to the selected frame contour of the recessed frame portion;

the opposed inner surface portions defining a ledge facing toward the base, such that the ledge operates to engage the slide lock element and pull it toward the base;

the ledge having an edge substantially flush with the interior surface portion;

the opposed inner surface portions defining a recess having a back wall with contours that engage features on the slide lock element; and the arms defining stop surfaces that limit upward motion of the tongs when the stop surfaces are engaged with a firearm and locate the ledge to engage the slide lock element.

22. The tool of claim 21, wherein the arms extend upwards from the base an angle of at least 0° from vertical and less than or equal to 15° from vertical.

23. Tongs for a firearm comprising:

a generally U-shaped body having two elongated arms joined at one end by a bottom portion;

the arms each having a free end portion;

each free end portion having an interior surface portion;

each interior surface portion defining a recess;

each interior surface portion having an upper portion above the recess and opposed lateral portions on opposed lateral sides of the recess;

each recess having a back wall;

each recess defining a ledge facing toward the bottom portion; and the ledge having an edge substantially flush with the opposed lateral portions of the interior surface portion.

24. The tongs of claim 23, wherein each of the arms has a textured exterior surface portion.

25. The tongs of claim 23, wherein each of the arms defines a stop surface that limits upward motion of the tongs when the stop surfaces are engaged with a firearm.

26. The tongs of claim 25, wherein the stop surfaces locate the recess in each interior surface portion to receive a slide lock of a firearm when the stop surfaces are engaged with the firearm.

27. The tongs of claim 25, wherein the stop surfaces are angled shapes that engage a radiused underside portion of a firearm frame above a trigger area defined by a trigger guard.

28. The tongs of claim 25, wherein the arms have a length sufficient such that the bottom portion does not contact a trigger guard when the stop surfaces are engaged with a firearm.

29. The tongs of claim 25, wherein each recess is located 0.38 inches above the stop surfaces.

30. The tongs of claim 25, wherein the distance between the stop surfaces is 0.78 inches.

31. The tongs of claim 25, wherein the distance between the bottom portion and the stop surfaces is 1.54 inches.

32. The tongs of claim 23, wherein the interior surface portions that define the recesses are flat.

33. The tongs of claim 23, wherein the bottom portion has a rounded, flattened cylindrical shape in cross-section.

34. The tongs of claim 23, wherein a portion of the arms between the bottom portion and the concave interior surface portions has a rounded, flattened cylindrical shape in cross-section.

35. The tongs of claim 23, wherein each recess has two teeth that define three compartments transverse to the arm.

36. The tongs of claim 35, wherein each of the arms defines a stop surface that limits upward motion of the tongs when the stop surfaces are engaged with a firearm.

37. The tongs of claim 36, wherein the two teeth are located 0.44 inches and 0.50 inches, respectively, above the stop surfaces.

38. The tongs of claim 23, wherein each recess is parallel to the arm.

39. The tongs of claim 23, wherein the arms extend upwards from the bottom portion at an angle of at least 0° from vertical and less than or equal to 15° from vertical.

* * * * *